US009082354B2

(12) United States Patent
Fujinaka

(10) Patent No.: US 9,082,354 B2
(45) Date of Patent: Jul. 14, 2015

(54) DISPLAY DEVICE AND CONTROL METHOD THEREFOR

(71) Applicant: CANON KABUSHIKI KAISHA, Tokyo (JP)

(72) Inventor: Kinshiro Fujinaka, Ebina (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 235 days.

(21) Appl. No.: 13/740,451

(22) Filed: Jan. 14, 2013

(65) Prior Publication Data

US 2013/0181961 A1 Jul. 18, 2013

(30) Foreign Application Priority Data

Jan. 17, 2012 (JP) ..... 2012-007062
Dec. 18, 2012 (JP) ..... 2012-275407

(51) Int. Cl.
*G09G 3/36* (2006.01)
*G09G 3/34* (2006.01)

(52) U.S. Cl.
CPC ..... *G09G 3/36* (2013.01); *G09G 3/3426* (2013.01); *G09G 3/3611* (2013.01); *G09G 2320/041* (2013.01); *G09G 2320/0626* (2013.01); *G09G 2360/145* (2013.01)

(58) Field of Classification Search
CPC ..... G09G 2320/041; G09G 2320/0233; G09G 3/3426; G09G 2320/0633; G09G 3/342
USPC ..... 345/102, 690, 87, 204, 89, 61, 72
See application file for complete search history.

(56) References Cited

U.S. PATENT DOCUMENTS 7,804,477 B2 * 9/2010 Sawada et al. ..... 345/101
2012/0274544 A1 * 11/2012 Nakajima ..... 345/101

FOREIGN PATENT DOCUMENTS

JP 2007-298957 11/2007

* cited by examiner

*Primary Examiner* — Koosha Sharifi-Tafreshi
(74) *Attorney, Agent, or Firm* — Cowan, Liebowitz & Latman, P.C.

(57) ABSTRACT

The present invention in its first aspect provides a display apparatus including a light emitting apparatus having a plurality of light sources, a brightness sensor that measures an emission brightness of the light emitting apparatus corresponding to each of blocks, a temperature sensor that measures a temperature of the light emitting apparatus corresponding to each of the blocks, an acquisition unit that acquires the measured value of the temperature sensor for each of the blocks, and an emission brightness control unit that performs processing of acquiring the measured value of the brightness sensor and controlling the emission brightness based on the measured value of the brightness sensor, in order from a block with a greatest difference between a temperature represented by the measured value acquired by the acquisition unit and a temperature represented by the measured value acquired in the past by the acquisition unit.

18 Claims, 13 Drawing Sheets

| PRIORITY | BLOCK | FIRST TEMPERATURE | TEMPERATURE DIFFERENCE |
|---|---|---|---|
| 1 | 5 | 22 | 12 |
| 2 | 4 | 15 | 10 |
| 3 | 6 | 15 | 10 |
| 4 | 8 | 22 | 10 |
| 5 | 9 | 20 | 9 |
| 6 | 7 | 18 | 8 |
| 7 | 3 | 26 | 7 |
| 8 | 2 | 24 | 6 |
| 9 | 1 | 25 | 5 |

TEMPERATURE DIFFERENCE IS SAME

FIG. 4C

| PRIORITY | BLOCK | FIRST TEMPERATURE | TEMPERATURE DIFFERENCE |
|---|---|---|---|
| 1 | 5 | 22 | 12 |
| 2 | 6 | 15 | 10 |
| 3 | 4 | 15 | 10 |
| 4 | 8 | 22 | 10 |
| 5 | 9 | 20 | 9 |
| 6 | 7 | 18 | 8 |
| 7 | 3 | 26 | 7 |
| 8 | 2 | 24 | 6 |
| 9 | 1 | 25 | 5 |

FIG. 8B

| REGION DETERMINATION RESULT | BLOCK | 頻度 |
|---|---|---|
| STABLE REGION | 1 | 1 |
| STABLE REGION | 2 | 1 |
| STABLE REGION | 3 | 1 |
| STABLE REGION | 4 | 1 |
| UNSTABLE REGION ADJACENT TO STABLE REGION | 5 | **4** |
| UNSTABLE REGION | 6 | 1 |
| STABLE REGION | 7 | 1 |
| STABLE REGION | 8 | 1 |
| STABLE REGION | 9 | 1 |
| STABLE REGION | 10 | 1 |
| UNSTABLE REGION ADJACENT TO STABLE REGION | 11 | **4** |
| UNSTABLE REGION ADJACENT TO STABLE REGION | 12 | **4** |
| STABLE REGION | 13 | 1 |
| : | : | : |
| STABLE REGION | 24 | 1 |

DISPLAY DEVICE AND CONTROL METHOD THEREFOR

BACKGROUND OF THE INVENTION

1. Field of the Invention

The present invention relates to a display apparatus and a control method therefor.

2. Description of the Related Art

In recent years, a liquid crystal display apparatus is becoming mainstream as an image display apparatus. A liquid crystal display apparatus is a display apparatus which displays images as a result of a liquid crystal panel transmitting or shielding light emitted from a backlight (light emitting apparatus).

With a liquid crystal display apparatus, a light emitting diode (LED) is often used as a light source of the backlight.

Moreover, certain liquid crystal display apparatuses can control the emission brightness of the backlight for each divided region obtained by dividing a region of a screen. This kind of control is hereinafter referred to as "local dimming control". The local dimming control can be performed, for example, with a liquid crystal display apparatus including a backlight provided with an LED for each divided region.

Moreover, with a liquid crystal display apparatus, brightness correction processing is performed using a measured value (sensor value) of the brightness sensor provided to the liquid crystal display apparatus in order to cause the emission brightness of the backlight to reach the target value.

The brightness control processing in a liquid crystal display apparatus capable of performing local dimming control is now explained in detail.

FIG. 10A is a diagram showing the state of the brightness correction processing. In the examples shown in FIGS. 10A to 10C, the respective regions obtained by dividing the region of the screen with a broken line are the blocks. The block and the foregoing divided region (one unit of local dimming control) may be the same or may be different. In order to perform the brightness correction processing, the liquid crystal display apparatus is provided with a brightness sensor for measuring the emission brightness of the backlight corresponding to each of blocks. The brightness correction processing is performed for each block. Specifically, for each block, the emission brightness of the backlight corresponding to that block is corrected by using the measured value of the brightness sensor corresponding to that block (emission brightness corresponding to that block). Measurement of the emission brightness by the brightness sensor is performed by turning OFF the LED of the blocks other than the block to be measured (only turning ON the LED of the block to be measured) in order obtain an accurate measured value (accurate emission brightness). Thus, it is difficult to simultaneously implement the brightness correction processing of a plurality of blocks, and the brightness correction processing of each block is often implemented in a predetermined order (specifically, the order shown with the arrow in FIG. 10A).

Nevertheless, with this kind of liquid crystal display apparatus, there are cases where a change occurs to the temperature of the backlight. For example, when there is a chip on a substrate located near the backlight, the temperature of the backlight will change due to the heat generated from that chip. Moreover, if the influence of the generation of heat from the chip on the temperature of the backlight differs among blocks, an uneven temperature distribution will occur in the backlight (there will be a temperature difference of the backlight among the blocks). For example, when a chip (heat source) is provided only to certain blocks, an uneven temperature distribution will occur in the backlight (FIG. 10B). Moreover, even in cases where a chip is provided to each block, since the amount of heat generated by the chip will change depending on the processing load of that chip, an uneven temperature distribution may occur in the backlight. Since LEDs and brightness sensors possess temperature characteristics, when the foregoing temperature distribution (temperature unevenness) occurs, it is not possible to perform an accurate correction, and brightness unevenness caused by the temperature of the backlight will occur.

Conventional technology for resolving the foregoing problems is disclosed, for example, in Japanese Patent Application Publication No. 2007-298957. Specifically, with the technology disclosed in Japanese Patent Application Publication No. 2007-298957, the temperature of the region of the screen is measured with a plurality of temperature sensors, and, when there is a considerable temperature difference between a certain region of the screen and the other regions of the screen, such certain region is driven based on driving conditions (for instance, length of voltage application) which are different from the other regions. Consequently, influence on the display caused by the temperature unevenness of the regions of the screen can be reduced, and images of favorable reproducibility can be displayed.

As a result of using the technology disclosed in Japanese Patent Application Publication No. 2007-298957, it is possible to perform the brightness correction processing in consideration of the temperature of the backlight. Specifically, as shown in FIG. 10C, the liquid crystal display apparatus may be provided with a temperature sensor for measuring the temperature of the backlight corresponding to each of blocks. Subsequently, the measured value of the brightness sensor may be corrected, for each block, according to the measured value of the temperature sensor corresponding to that block (temperature corresponding to that block). Consequently, it is possible to realize the brightness correction processing in consideration of the temperature of the backlight.

Nevertheless, as described above, the brightness correction processing (emission brightness measurement) of the respective blocks is performed in a predetermined order. Thus, with a block subject to a considerably temperature change from an ending time of the brightness correction processing to a starting time of the subsequent brightness correction processing, the brightness correction processing will be too late, and brightness unevenness (unevenness in the emission brightness of the backlight) caused by the temperature change will occur around that block. This kind of brightness unevenness will occur, for example, when the temperature changes as a result of the target brightness changing such as when the display mode of the liquid crystal display apparatus is switched.

SUMMARY OF THE INVENTION

The present invention provides technology for causing the emission brightness of the light emitting apparatus to accurately achieve the target value.

The present invention in its first aspect provides a display apparatus including alight emitting apparatus having a plurality of light sources in which emission of light can be controlled independently, the display apparatus comprising:

a brightness sensor that measures an emission brightness of the light emitting apparatus corresponding to each of blocks obtained by dividing a region of an image based on an input image data;

a temperature sensor that measures a temperature of the light emitting apparatus corresponding to each of the blocks; and a control unit that controls, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control unit includes:

an acquisition unit that acquires the measured value of the temperature sensor for each of the blocks; and an emission brightness control unit that performs processing of acquiring the measured value of the brightness sensor and controlling the emission brightness of the light emitting apparatus based on the measured value of the brightness sensor, in order from a block with a greatest difference between a temperature represented by the measured value acquired by the acquisition unit and a temperature represented by the measured value acquired in the past by the acquisition unit.

The present invention in its second aspect provides a display apparatus including a light emitting apparatus having a plurality of light sources in which emission of light can be controlled independently, the display apparatus comprising:

a brightness sensor that measures an emission brightness of the light emitting apparatus corresponding to each of blocks obtained by dividing a region of an image based on an input image data;

a temperature sensor that measures a temperature of the light emitting apparatus corresponding to each of the blocks; and a control unit that controls, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control unit includes:

an acquisition unit that acquires the measured value of the temperature sensor for each of the blocks;

a determination unit that determines, for each block, whether that block is a first region which is a region in which the temperature represented by the measured value acquired by the acquisition unit is not less than a predetermined threshold, or a second region in which the temperature represented by the measured value acquired by the acquisition unit is less than a predetermined threshold; and an emission brightness control unit that performs regarding a block which is the second region adjacent to the first region, at a frequency higher than that for other blocks, processing of acquiring the measured value of the brightness sensor and controlling the emission brightness of the light emitting apparatus based on the measured value of the brightness sensor.

The present invention in its third aspect provides a control method for a display apparatus including a light emitting apparatus having a plurality of light sources in which emission of light can be controlled independently, a brightness sensor that measures an emission brightness of the light emitting apparatus corresponding to each of blocks obtained by dividing a region of an image based on an input image data, and a temperature sensor that measures a temperature of the light emitting apparatus corresponding to each of the blocks, the control method comprising:

a control step of controlling, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control step includes:

an acquisition step of acquiring the measured value of the temperature sensor for each of the blocks; and an emission brightness control step of performing processing of acquiring the measured value of the brightness sensor and controlling the emission brightness of the light emitting apparatus based on the measured value of the brightness sensor, in order from a block with a greatest difference between a temperature represented by the measured value acquired in the acquisition step and a temperature represented by the measured value acquired in the past in the acquisition step.

The present invention in its fourth aspect provides a control method for a display apparatus including a light emitting apparatus having a plurality of light sources in which emission of light can be controlled independently, a brightness sensor that measures an emission brightness of the light emitting apparatus corresponding to each of blocks obtained by dividing a region of an image based on an input image data, and a temperature sensor that measures a temperature of the light emitting apparatus corresponding to each of the blocks, the control method comprising:

a control step of controlling, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control step includes:

an acquisition step of acquiring the measured value of the temperature sensor for each of the blocks;

a determination step of determining, for each block, whether a block is a first region in which the temperature represented by the measured value acquired in the acquisition step is not less than a predetermined threshold, or a second region in which the temperature represented by the measured value acquired in the acquisition step is less than a predetermined threshold; and an emission brightness control step of performing, regarding a block which is the second region adjacent to the first region, at a frequency higher than that for other blocks, processing of acquiring the measured value of the brightness sensor and controlling the emission brightness of the light emitting apparatus based on the measured value of the brightness sensor.

According to the present invention, it is possible to cause the emission brightness of the light emitting apparatus to accurately achieve the target value.

Further features of the present invention will become apparent from the following description of exemplary embodiments with reference to the attached drawings.

BRIEF DESCRIPTION OF THE DRAWINGS

FIGS. 4A to 4C are diagrams showing an example of the processing flow of the priority determination unit according to Embodiment 1;

FIGS. 8A and 8B are diagrams showing an example of the processing flow of the implementation frequency determination unit according to Embodiment 2;

DESCRIPTION OF THE EMBODIMENTS

Embodiment 1

The display apparatus and a control method therefor according to Embodiment 1 of the present invention are now explained with reference to the appended drawings. The display apparatus according to Embodiment 1 includes a light emitting apparatus comprising a plurality of light sources in which the emission of light can be controlled independently. Note that, in this embodiment, a case is explained in which the display apparatus is a liquid crystal display apparatus including a light emitting apparatus (backlight) and a liquid crystal panel, but the display apparatus is not limited to a liquid crystal display apparatus. For example, in substitute for a liquid crystal panel, a display panel including a display element other than a liquid crystal element as the display element which transmits light from the light emitting apparatus may also be used.

Figures 4A, 4B:
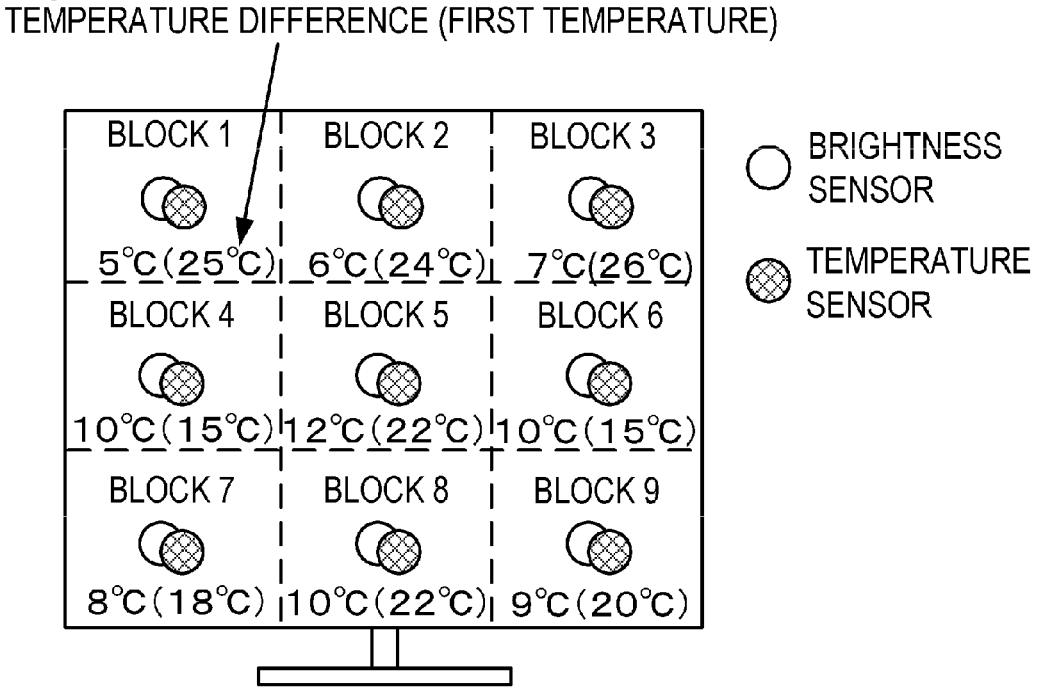

In Embodiment 1, as one example, it is assumed that a region of an image based on an input image data is divided into 3 lines×3 columns=9 blocks (blocks 1 to 9 of FIG. 4A). In other words, the region of the screen is divided into 3 lines×3 columns=9 blocks (blocks 1 to 9 of FIG. 4A). Moreover, it is assumed that the liquid crystal display apparatus according to Embodiment 1 includes a brightness sensor for measuring the emission brightness of the backlight corresponding to each of blocks. In addition, it is assumed that the liquid crystal display apparatus according to Embodiment 1 includes a function of performing, for each block, the brightness correction processing of causing the emission brightness of the backlight corresponding to that block to approach the target value based on the measured value (brightness measured value) of the brightness sensor corresponding to that block. Here, the foregoing brightness sensor possesses temperature characteristics, and the value of the brightness sensor will change when the ambient temperature changes. In order to correct this kind of change, the liquid crystal display apparatus according to Embodiment 1 includes a temperature sensor for measuring the temperature of the backlight corresponding to each of blocks. The number of temperature sensors and the number of brightness sensors are the same.

In addition, with the liquid crystal display apparatus according to Embodiment 1, the foregoing brightness correction processing is performed so that the emission brightness of the backlight achieves (indicates) the target value accurately.

Note that, as described above, while Embodiment 1 explains a case where the number of blocks is 9 blocks, the number of blocks is not limited thereto. The number of blocks may be more than or less than 9 blocks. Moreover, the blocks are not limited to regions that are obtained by dividing the region of the screen in a matrix. For example, the blocks may also be regions that are obtained by dividing the region of the screen in a stripe shape.

Figure 1:
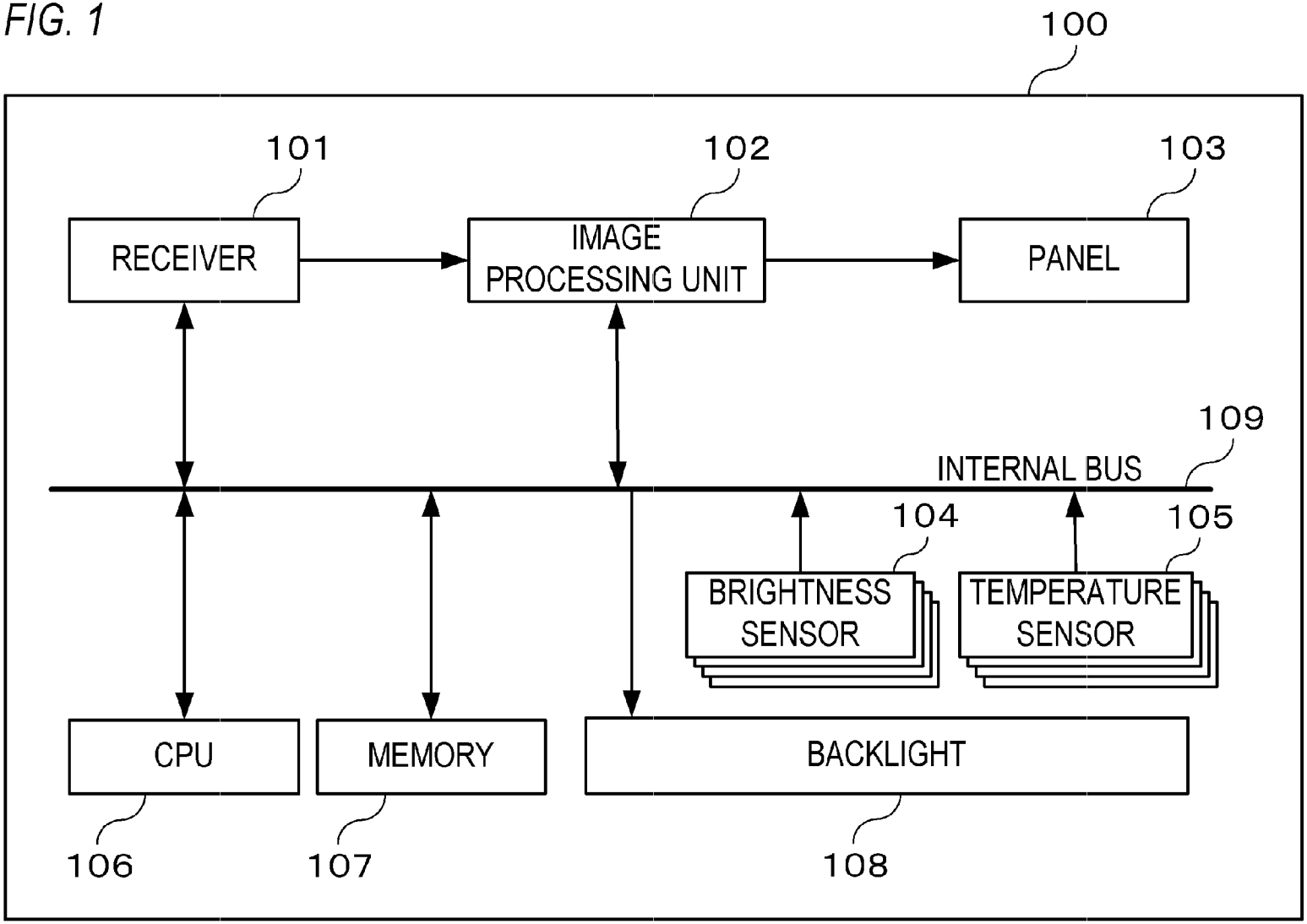
FIG. 1 is a block diagram showing an example of the hardware configuration of the liquid crystal display apparatus according to Embodiment 1.

FIG. 1 is a hardware block diagram showing an example of the hardware configuration of the liquid crystal display apparatus 100 according to Embodiment 1.

A receiver 101 acquires an image data (an image signal) input from the outside, performs predetermined processing such as format conversion to the acquired image data, and outputs the processed image data to an image processing unit 102. The image data is input, for example, from an image input terminal such as a Display Port.

The image processing unit 102 performs predetermined image processing to the image data output from the receiver 101, and outputs the processed image data to a panel 103 (liquid crystal panel). The predetermined image processing is, for example, gamma conversion processing or change processing of the color temperature (for example, white color temperature). Moreover, the predetermined image processing may also be processing that is performed based on the target value of the emission brightness of the backlight 108. For example, the predetermined image processing may also be image processing of increasing the gradation of an image on the low gradation side when the target value is low (when the luminance of a backlight 108 is to be darkened), and increasing the gradation of an image on the high gradation side when the target value is high (when brightening the luminance of the backlight 108). Moreover, as the predetermined image processing, one type of image processing may be performed, or a plurality of types of image processing may be performed.

The panel 103 is a liquid crystal panel including a plurality of liquid crystal elements in which the transmittance is controlled based on the image data output from the image processing unit 102.

The backlight 108 is configured so that the emission brightness can be controlled for each block. Specifically, the backlight 108 includes a light source (LED) for each block. The rear face of the panel 103 is irradiated with the light from the backlight 108.

As a result of the light from the backlight 108 being transmitted through the panel 103, or shielded by the panel 103, an image based on the image data output from the image processing unit 102 is displayed on the screen.

A plurality of brightness sensors 104 are each a sensor for measuring the emission brightness of the backlight 108 (LED) corresponding to the corresponding block.

The plurality of temperature sensors 105 are each a sensor for measuring the temperature of the backlight 108 (LED) corresponding to the corresponding block (specifically, ambient temperature of the brightness sensor 104 corresponding to the corresponding block).

The CPU 106 is a central processing unit (CPU) which implements the various types of control. Specifically, the CPU 106 controls, in order, the emission brightness of the backlight (LED) corresponding to the respective blocks so that the emission brightness achieves the target value by using the measured value (brightness measured value) of the brightness sensor 104 for each block, and the measured value (temperature measured value) of the temperature sensor 105 for each block. More specifically, the CPU 106 implements the control of acquiring the brightness measured value and temperature measured value for each block, and the control for the method of acquiring such measured values (sensor values). Subsequently, the CPU 106 performs the control (brightness correction processing; emission brightness control), for each block, of correcting the brightness measured value of that block and causing the emission brightness of the backlight 108 corresponding to that block to achieve the target value by using the corrected brightness measured value.

Note that, in this embodiment, the brightness measured value is corrected based on the temperature measured value of the same block. However, the correction method is not limited thereto. The brightness measured value may also be corrected based on the temperature measured value of the same block, and the temperature measured value of the block that is adjacent to that block.

A memory 107 stores the rightness measured value output from the brightness sensor 104 and the temperature measured value output from the temperature sensor 105.

The internal bus 109 connects the foregoing hardware blocks in a manner which enables the sending and receiving of information (data).

Figure 2:
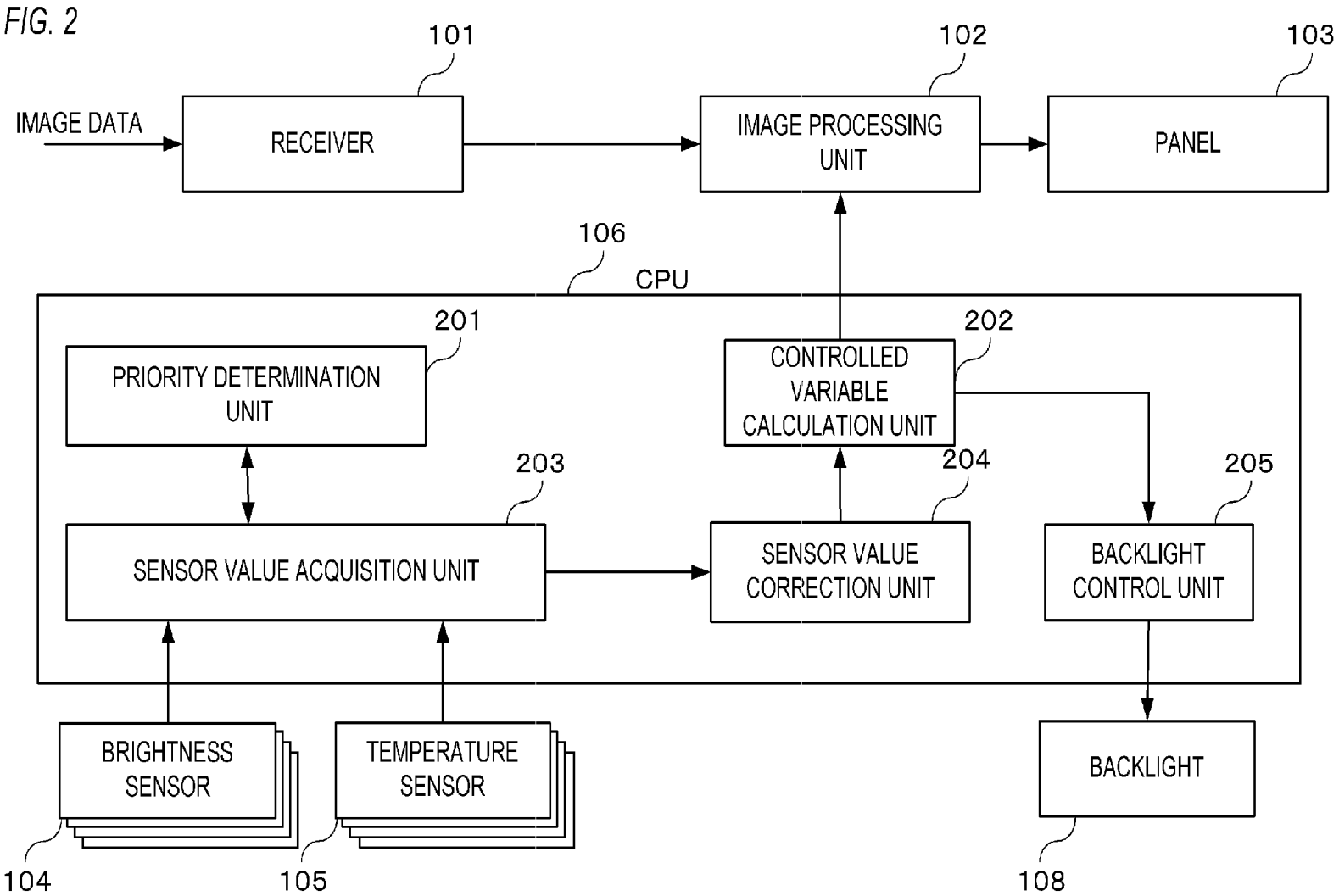
FIG. 2 is a block diagram showing an example of the functional configuration of the CPU according to Embodiment 1.

FIG. 2 is a functional block diagram showing an example of the functional configuration of the CPU 106.

The priority determination unit 201 issues a command to the sensor value acquisition unit 203 described later for acquiring the temperature measured value for each block. The acquisition command of the temperature measured value is issued periodically. Moreover, the priority determination unit 201 calculates, for each block, the difference between the temperature (first temperature) represented by the temperature measured value acquired this time by the sensor value acquisition unit 203, and the temperature (second temperature) represented by the temperature measured value acquired the previous time by the sensor value acquisition unit 203. In addition, the priority determination unit 201 determines the priority of the respective blocks so that the brightness correction processing is performed in order from the block in which the foregoing difference is the greatest. Specifically, the priority of the respective blocks is determined so that the processing of acquiring the brightness measured value and controlling the emission brightness of the backlight 108 (LED) based on the brightness measured value is performed in order from the block in which the foregoing difference is greatest. For example, the priority determination unit 201 determines, for each block, the priority to be higher as the foregoing difference is greater. In addition, the priority determination unit 201 issues a command to the sensor value acquisition unit 203 for acquiring the temperature measured value for each block so that the brightness measured value is acquired in order from the block having the highest priority. The specific priority determination method will be described later.

Note that the foregoing difference may be a value obtained by subtracting the second temperature from the first temperature, a value obtained by subtracting the first temperature from the second temperature, or an absolute value thereof.

Note that, in this embodiment, while the second temperature was explained as the temperature that is represented by the temperature measured value acquired the previous time by the sensor value acquisition unit 203, the second temperature is not limited thereto. The second temperature will suffice so as long as it is a temperature that is represented by the temperature measured value acquired in the past by the sensor value acquisition unit 203. For example, the second temperature may also be a temperature that is represented by the temperature measured value acquired the time before the previous time by the sensor value acquisition unit 203. The second temperature may also be a temperature that is represented by the temperature measured value acquired a predetermined number of times (3 times back, 5 times back, 8 times back or the like) in the past by the sensor value acquisition unit 203.

The controlled variable calculation unit 202 calculates the controlled variable of the emission brightness of the backlight.

Specifically, the controlled variable calculation unit 202 calculates, for each block, the controlled variable of the emission brightness of the backlight corresponding to that block from the brightness measured value of that block (brightness measured value output from the sensor value correction unit 204 described later) and the target value. Specifically, when the emission brightness represented by the brightness measured value is lower than the target value, a controlled variable for increasing the emission brightness for causing the emission brightness represented by the brightness measured value to achieve the target value is calculated. When the emission brightness represented by the brightness measured value is higher than the target value, a controlled variable for decreasing the emission brightness for causing the emission brightness represented by the brightness measured value to achieve the target value is calculated. The calculated controlled variable is output to the backlight control unit 205. The controlled variable is calculated each time the brightness measured value is output from the sensor value correction unit 204, and then output.

Moreover, the controlled variable calculation unit 202 outputs the target value of the emission brightness to the image processing unit 102. Subsequently, the image processing unit 102 performs image processing based on the target value of the emission brightness.

Note that the controlled variable calculation unit 202 may also calculate the correction amount of the respective pixels of the image data from the image data and the target value of the emission brightness, and output the calculated correction amount to the image processing unit 102. In addition, the image processing unit 102 may also correct the image data according to the correction amount of the respective pixels. The correction amount of the respective pixel values can be calculated, for example, based on the brightness of the image that is calculated from the image data and the target value of the emission brightness. Moreover, the correction amount of the respective pixel values may be calculated by using a conversion table (a table (or function) representing the correspondence relation input pixel value (before conversion) and correction amount) for each target value.

Note that the controlled variable calculation unit 202 may also calculate the pixel value of the image data after being subject to image processing from the target value of the emission brightness, and output the calculated pixel value to the image processing unit 102. In addition, the image processing unit 102 may perform the processing of substituting the respective pixel values of the image data with the values output from the controlled variable calculation unit 202. The pixel value after the image processing may be calculated, for example, by using a conversion table (a table (or function) representing the correspondence relation of input pixel value (before image processing) and output pixel value (after image processing)) for each target value.

Note that the target value is set, for example, according to the user's operation, the input image data, the ambient environment of the liquid crystal display apparatus 100, or the like. The target value may be set by the controlled variable calculation unit 202, or set by a different functional block. The target value may be a value that is common to all blocks, or a value for each block.

The sensor value acquisition unit 203 acquires the sensor values from the brightness sensor 104 and the temperature sensor 105 corresponding to the respective blocks. In other words, the sensor value acquisition unit 203 acquires the brightness measured value and the temperature measured value of the respective blocks. Note that the functional block to acquire the brightness measured value and the functional block to acquire the temperature measured value may be mutually different functional blocks.

Since the emission brightness of the backlight 108 will not be stable for a while after it is changed, the brightness measured value may be acquired from the brightness sensor 104 every several hundred msec. Note that the acquired brightness measured value may be a value that represents the emission brightness at the time of acquisition, or a value that represents the average value of the emission brightness of a predetermined period up to the time of acquisition.

The temperature measured value may be acquired instantaneously from the temperature sensor 105. For example, the temperature measured value may be acquired from the temperature sensor 105 every several μsec.

In this embodiment, the temperature measured value of the respective blocks is acquired in a predetermined order. However, the method of acquiring the temperature measured value is not limited to the foregoing method. For example, the temperature measured value of the respective blocks may be acquired at once, or acquired in order from the block with the highest priority that was calculated most recently.

In addition, in this embodiment, the brightness measured value of the respective blocks is acquired in order from the block with the highest priority that was calculated most recently.

The sensor value correction unit 204 corrects the brightness measured value acquired by the sensor value acquisition unit 203 by using the temperature measured value acquired by the sensor value acquisition unit 203, and outputs the result to the controlled variable calculation unit 202, for each block. In this embodiment, the temperature measured value that is used for correcting the brightness measured value is acquired separately from the temperature measured value (temperature measured value of the first and second temperatures) to be used for determining the order of performing the brightness correction processing (order of acquiring the brightness measured value) (details will be described later). Each time the brightness measured value is acquired by the sensor value acquisition unit 203 (each time the brightness measured value is output from the sensor value acquisition unit 203 to the sensor value correction unit 204), the sensor value correction unit 204 corrects that brightness measured value, and outputs the result to the controlled variable calculation unit 202.

The backlight control unit 205 controls, for each block, the emission brightness of the backlight 108 according to the controlled variable that was output from the controlled variable calculation unit 202. The control of the emission brightness is performed each time a controlled variable is output from the controlled variable calculation unit 202.

In other words, in this embodiment, the brightness measured value is acquired by the sensor value acquisition unit 203, in order, from the block in which the temporal variation of the temperature (foregoing difference) is the greatest. In addition, each time the brightness measured value of the block is acquired by the sensor value acquisition unit 203, the emission brightness of that block is controlled by the sensor value correction unit 204, the controlled variable calculation unit 202, and the backlight control unit 205 (brightness correction processing of that block is performed).

Figure 3:
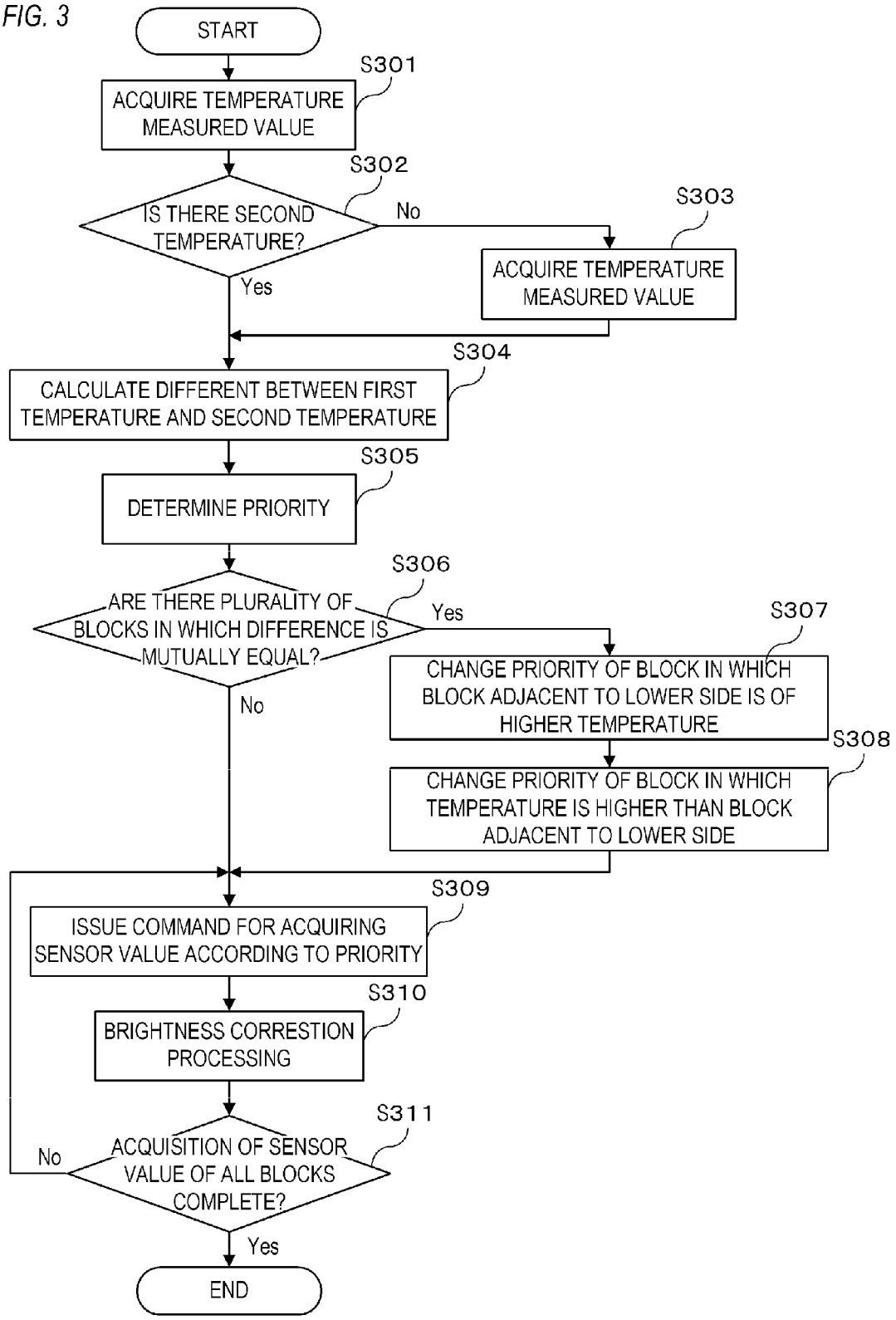
FIG. 3 is a flowchart showing an example of the processing flow of the priority determination unit according to Embodiment 1.

An example of the processing flow of the priority determination unit 201 is explained with reference to FIG. 3 and FIGS. 4A to 4C. FIG. 3 is a flowchart showing an example of the processing flow of the priority determination unit 201. FIG. 4A is a diagram showing an example of the first temperature of the respective block and the temporal variation of the temperature (difference between the first temperature and the second temperature). FIGS. 4B and 4C are diagram showing an example of the priority of the respective blocks. Note that the priority determination unit 201 includes a memory capable of storing the values (temperature, temporal variation of temperature (temperature difference), and priority for each block) shown in FIG. 4B. In this embodiment, an identifier ID for identifying a block is predetermined for each block, and the temperature and the temporal variation of the temperature are recorded by being associated with the identifier ID of the corresponding block.

Foremost, the priority determination unit 201 sequentially acquires the current temperature measured value of the respective blocks (total of 9 blocks) from the sensor value acquisition unit 203 (S301).

Subsequently, the priority determination unit 201 determines whether a temperature (second temperature) is recorded in the memory (S302).

When a second temperature is recorded in the memory, the processing proceeds to S304.

When a second temperature is not recorded in the memory, the priority determination unit 201 records the first temperature (temperature represented by the temperature measured value acquired in S301) of the respective blocks in the memory, and, after the lapse of a predetermined time, sequentially acquires the current temperature measured value of the respective blocks (S303). When the processing of S303 is complete, the temperature of the respective blocks recorded in the memory becomes a second temperature. The processing thereafter proceeds to S304.

In S304, the priority determination unit 201 calculates the temporal variation of temperature for each block. Specifically, the difference between the temperature (first temperature) represented by the temperature measured value acquired in S301 or S303 and the second temperature stored in the memory is calculated. In addition, the priority determination unit 201 records the temperature data (first temperature and temporal variation of temperature) for each block in the memory. Specifically, in the memory, the temperature data is stored in order for each block.

Subsequently, the priority determination unit 201 rearranges the temperature data of the respective blocks recorded in the memory in descending order of the difference (temporal variation of temperature) calculated in S304. In addition, the priority determination unit 201 assigns a priority of 1 (high) to 9 (low), in that order, from the initial (top; first) to the last (9th) temperature data after rearrangement (S305). In other words, a higher priority is assigned to a block with a greater difference calculated in S304. Based on this processing, the priority of the respective blocks is determined as shown in FIG. 4B.

Subsequently, the priority determination unit 201 determines whether there are a plurality of blocks in which the difference (temporal variation of temperature) is mutually equal (S306).

When there are a plurality of blocks in which the temporal variation of temperature is mutually equal, the processing proceeds to S307.

When there are no plurality of blocks in which the temporal variation of temperature is mutually equal, the processing proceeds to S309.

In a liquid crystal display apparatus, the temperature tends to carry from the lower side toward the upper side. Thus, when the temperature of a block B adjacent to the lower side of a block A is higher than the temperature of the block A, the temperature of the block B tends to carry to the block A. When this kind of temperature propagation occurs, the temperature (temperature measured value) of the block A will change. Moreover, the greater the temperature difference between the block A and the block B, the greater the temperature change of the block A.

Thus, in S307 and S308, the priority determination unit 201 corrects the priority from the first temperature of the plurality of blocks in which the temporal variation of temperature is mutually equal, and the blocks that are adjacent to the lower side of those blocks. Specifically, the priority is corrected so that, among the plurality of blocks in which the temporal variation of temperature is mutually equal, the emission brightness of the block in which the temperature of the block adjacent to the lower side (lower side high temperature block) is higher is preferentially controlled. Moreover, when there are a plurality of lower side high temperature blocks, the priority is corrected so that the emission brightness of the backlight corresponding to the lower side high temperature block with a greater difference in temperature in comparison to the temperature of the block adjacent to the lower side is preferentially controlled. To put it differently, the priority is corrected so that, among the plurality of blocks in which the temporal variation of temperature is mutually equal, the emission brightness of the backlight corresponding to the block in which the temperature of the block adjacent to the lower side is higher and in which the block with a greater difference in temperature in comparison to the temperature of the block adjacent to the lower side is preferentially controlled. In S307, among the plurality of blocks in which the temporal variation of temperature is mutually equal, the priority of the block in which the temperature of the block adjacent to the lower side is higher is corrected. In S308, among the plurality of blocks in which the temporal variation of temperature is mutually equal, the priority of the block having a higher temperature than the block adjacent to the lower side is corrected. After the priority of the plurality of blocks in which the temporal variation of temperature is mutually equal is corrected, the priority determination unit 201 rearranges the temperature data of those blocks recorded in the memory in descending order of the corrected priority.

After the processing of S307 and S308, the processing proceeds to S309.

In the example shown in FIG. 4B, the temporal variation of temperature of the blocks 4, 6, 8 is mutually the same (10° C.). The first temperature of the blocks 4, 6, 8 is respectively 15° C., 15° C., 22° C. In addition, the first temperature of the block 7 adjacent to the lower side of the block 4 is 18° C., and the first temperature of the block 9 adjacent to the lower side of the block 6 is 20° C. There is no block that is adjacent to the lower side of the block 8. The priority of the block 4 before correction is 2, the priority of the block 6 before correction is 3, and the priority of the block 8 before correction is 4.

The first temperature of the blocks 7, 9 is respectively higher than the temperature of the blocks 4, 6. Moreover, the difference (5° C.) between the first temperature of the block 9 and the first temperature of the block 6 is greater than the difference (3° C.) between the first temperature of the block 7 and the first temperature of the block 4. Thus, the priority of the blocks 4, 6 is corrected so that, among the blocks 4, 6, 8, the priority of the block 6 becomes the highest and the priority of the block 4 becomes the next highest. Specifically, the priority of the block 6 after correction becomes 2, and the priority of the block 4 after correction becomes 3.

In addition, since no block is adjacent to the lower side of the block 8, the priority of the block 8 is set to be a priority that is lower than the priority of the blocks 4, 6 after correction. Specifically, as shown in FIG. 4C, the priority of the block 8 after correction is 4, which is the same priority as before the correction. Note that the priority of the block 8 is determined (corrected) in the same manner in cases where there is a block, which has a temperature that is lower than the block 8, is adjacent to the lower side of the block 8.

Note that, as described above, in this embodiment, the priority is corrected so that, among the plurality of blocks in which the temporal variation of temperature is mutually equal, the emission brightness of the block in which the block adjacent to the lower side is of higher temperature is preferentially controlled. Thus, when the temperature of the block 9 adjacent to the lower side of the block 6 is lower than the temperature of the block 6, the priority of the blocks 4, 6, 8 is corrected so that the priority of the block 4 becomes the highest among the blocks 4, 6, 8. Moreover, even in cases where the temporal variation of temperature of only the blocks 4, 8 is mutually equal (when the temporal variation of temperature of the block 6 is not 10° C.), the priority is corrected so that the priority of the block 4 becomes higher than the priority of the block 8.

In S309, the priority determination unit 201 issues a command to the sensor value acquisition unit 203 for acquiring the sensor value according to the priority determined in the processing of S301 to S308. Consequently, the sensor value acquisition unit 203 acquires the measured values of the temperature sensor 105 and the brightness sensor 104 (current temperature measured value and brightness measured value) in order from the block having the highest priority determined in the processing of S301 to S308, and the acquired measured values are output to the sensor value correction unit 204. The temperature measured value acquired here is the temperature measured value for correcting the brightness measured value. Accordingly, in this embodiment, the temperature measured value that is used for correcting the brightness measured value is acquired separately from the temperature measured value that is used for determining the acquisition order of the brightness measured value. Note that the temperature measured value that is used for correcting the brightness measured value and the temperature measured value that is used for determining the acquisition order of the brightness measured value do not have to be differentiated. The brightness measured value may also be corrected based on the first temperature.

Each time a sensor value is acquired in S309, the brightness correction processing is performed by the sensor value correction unit 204, the controlled variable calculation unit 202, and the backlight control unit 205 (S310).

Subsequently, the priority determination unit 201 determines whether the sensor value for performing the brightness correction processing has been acquired regarding all blocks (whether the brightness correction processing of all blocks is complete) (S311).

When there is a block in which the sensor value for performing the brightness correction processing has not been acquired (when the brightness correction processing of all blocks is not completed), the processing returns to S309.

When the sensor value for performing the brightness correction processing has been acquired regarding all blocks (when the brightness correction processing of all blocks is completed), this flow is ended.

Note that the processing flow of FIG. 3 may be repeatedly performed at all times, or performed only during a specific period. A specific period is, for example, a predetermined period with the time that the display mode was changed as the starting point, or a predetermined period with the time that the difference between the ambient temperature of the liquid crystal display apparatus and the temperature at the time that the previous brightness correction processing was performed becoming a predetermined value or more as the starting point.

As described above, according to this embodiment, the processing of acquiring the brightness measured value and controlling the emission brightness of the backlight is performed in order from the block having the greatest temporal change of temperature. Consequently, it is possible to more accurately cause the emission brightness of the backlight to achieve the target value in comparison to conventional methods.

Specifically, with a block with a large temporal change of temperature, in comparison to a block with a small temporal change of temperature, it is considered that the emission brightness of the backlight is considerably deviated from the target value. If the deviation of the emission brightness from the target value differs among the blocks, the emission brightness of the overall backlight becomes unevenness. According to this embodiment, based on the foregoing configuration, regarding a block with a large temporal change of temperature, it is possible to shorten the time from performing the brightness correction processing to performing the subsequent brightness correction processing in comparison to conventional methods. Consequently, it is possible to shorten the period that the emission brightness of the backlight deviates from the target value due to a temperature change (period that the emission brightness is uneven due to a temperature change) in comparison to conventional methods. In addition, it is possible to maintain the emission brightness of the backlight at the target value (brightness near the target value).

Moreover, according to this embodiment, among the plurality of blocks in which the temporal variation of temperature is mutually equal, the emission brightness of the backlight corresponding to a block in which the block adjacent to the lower side is of a higher temperature and which is a block having a greater difference in temperature in comparison to the temperature of the block adjacent to the lower side is preferentially controlled. In other words, among the plurality of blocks in which the temporal variation of temperature is mutually equal, the emission brightness of the backlight corresponding to a block in which a considerably change in temperature is anticipated is preferentially controlled. Consequently, it is possible to cause the emission brightness of the backlight to achieve the target value with even greater accuracy. Specifically, among the blocks in which the temporal change of temperature is severe, it is possible to preferentially shorten the time of performing the brightness correction processing to performing the subsequent brightness correction processing of blocks with particularly great time change.

Note that, in this embodiment, while the brightness measured value is corrected based on the temperature measured value, such a correction does not need to be performed. The temperature measured value may also be used only for determining the order of the brightness correction processing.

Note that, in this embodiment, while a case of using an LED as the light source of the backlight was explained, the light source is not limited to an LED. The light source may also be, for example, a cold-cathode tube.

Embodiment 2

The liquid crystal display apparatus and a control method therefor according to Embodiment 2 of the present invention are now explained with reference to the relevant drawings. Note that the functions that are different from Embodiment 1 will be described in detail in the ensuing explanation, and the explanation of the functions that are the same as Embodiment 1 is omitted. The liquid crystal display apparatus according to Embodiment 2 determines, for each block, whether that block is a stable region (first region) or an unstable region (second region) by using the temperature measured value of that block. A stable region is a region where the temperature represented by the temperature measured value is a predetermined threshold or higher. An unstable region is a region where the temperature represented by the temperature measured value is less than a predetermined threshold. As a specific example of the temperature threshold, 55° C. may be used. In addition, the liquid crystal display apparatus according to Embodiment 2 performs, regarding a block as an unstable region that is adjacent to the stable region, in a frequency that is higher than the other blocks, processing of acquiring the measured value of the brightness sensor and controlling the emission brightness of the backlight based on the measured value of the brightness sensor. Consequently, it is possible to cause the emission brightness of the backlight to achieve the target value more accurately in comparison to conventional methods.

Since the hardware configuration of the liquid crystal display apparatus according to Embodiment 2 is the same as Embodiment 1, the explanation thereof is omitted.

Figure 5:
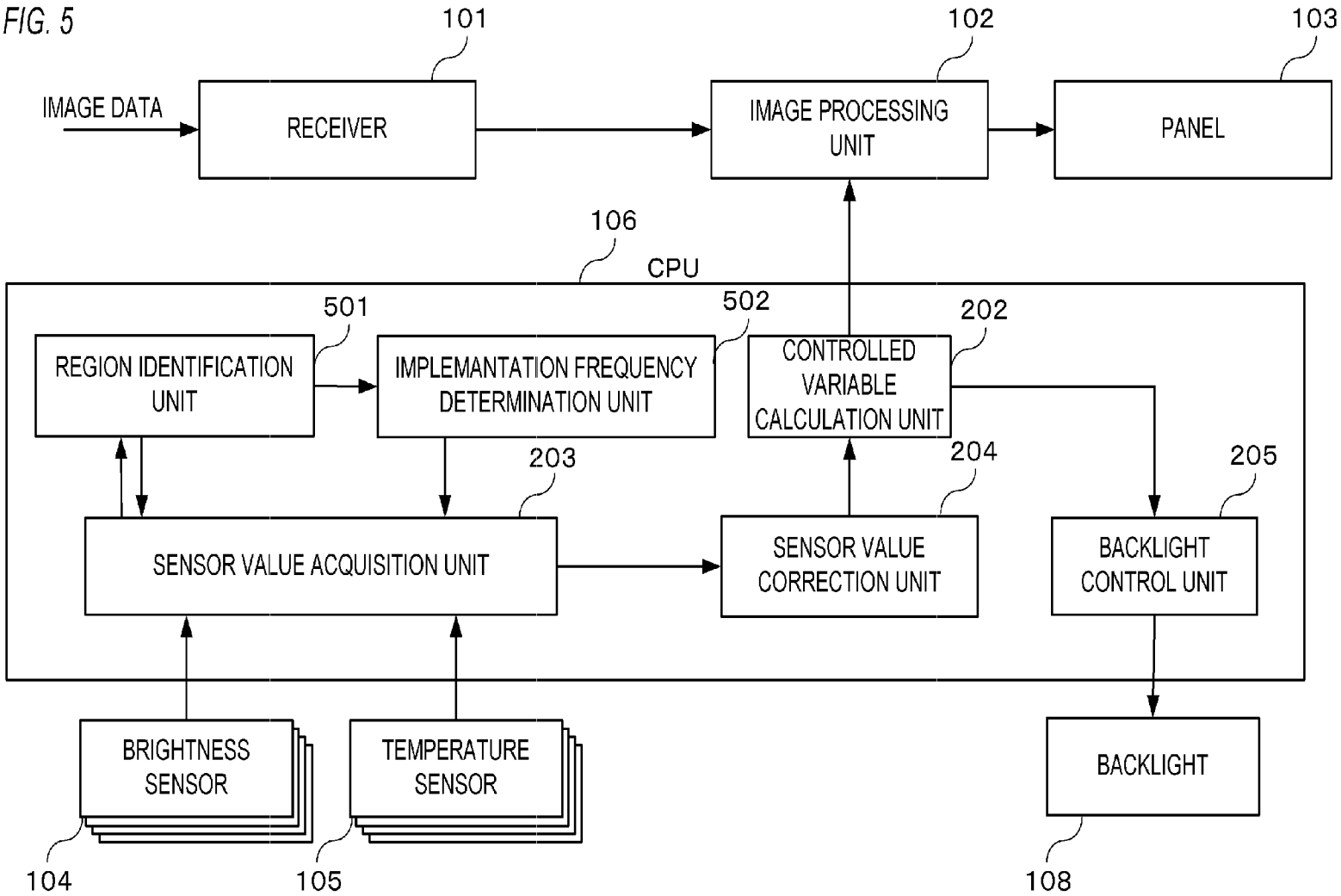
FIG. 5 is a block diagram showing an example of the functional configuration of the CPU according to Embodiment 2.

FIG. 5 is a functional block diagram showing an example of the functional configuration of a CPU 106 according to Embodiment 2.

The region identification unit 501 issues a command to the sensor value acquisition unit 203 for acquiring the temperature measured value for each block. In addition, the region identification unit 501 determines, for each block, whether that block is a stable region or an unstable region from the temperature measured value of that block. The determination result of the respective blocks (determination result on whether that block is a stable region or an unstable region; region determination result) is output to the implementation frequency determination unit 502.

The implementation frequency determination unit 502 acquires the region determination result of the respective blocks from the region identification unit 501, and determines the implementation frequency of the brightness correction processing of the respective blocks (processing implementation frequency) by using the region determination result of the respective blocks. Specifically, the implementation frequency of the processing of acquiring the measured value (brightness measured value) of the brightness sensor 104, and controlling the emission brightness of the backlight based on the brightness measured value is determined. In addition, the implementation frequency determination unit 502 issues a command to the sensor value acquisition unit 203 for acquiring the brightness measured value of the respective blocks according to the determined processing implementation frequency of the respective blocks. Each time a brightness measured value is acquired, the same brightness correction processing as Embodiment 1 is performed.

When a stable region and an unstable region are adjacent to each other, it is anticipated that the temperature of the stable region will be transferred to the unstable region, and the temperature of the unstable region will rise in a short period of time. In other words, in this kind of unstable region, the emission brightness of the backlight will deviate considerably from the target value in a short period, and it is anticipated that the emission brightness of the overall backlight will become uneven.

Thus, in this embodiment, a higher processing implementation frequency is set to a block as an unstable region that is adjacent to a stable region than the other blocks. Consequently, regarding a block as an unstable region that is adjacent to a stable region, at a higher frequency than the other blocks, the processing of acquiring the brightness measured value and controlling the emission brightness of the backlight based on the brightness measured value is performed. In other words, the emission brightness of a block in which the temperature will change in a short period (block in which the emission brightness of the backlight will considerably deviate from the target value in a short period) is corrected (controlled) at a higher frequency than the emission brightness of the other blocks. Consequently, the duration that the emission brightness of the backlight deviates from the target value due to a temperature change can be shortened in comparison to conventional methods, and the emission brightness of the backlight can achieve the target value more accurately in comparison to conventional methods.

Figure 6:
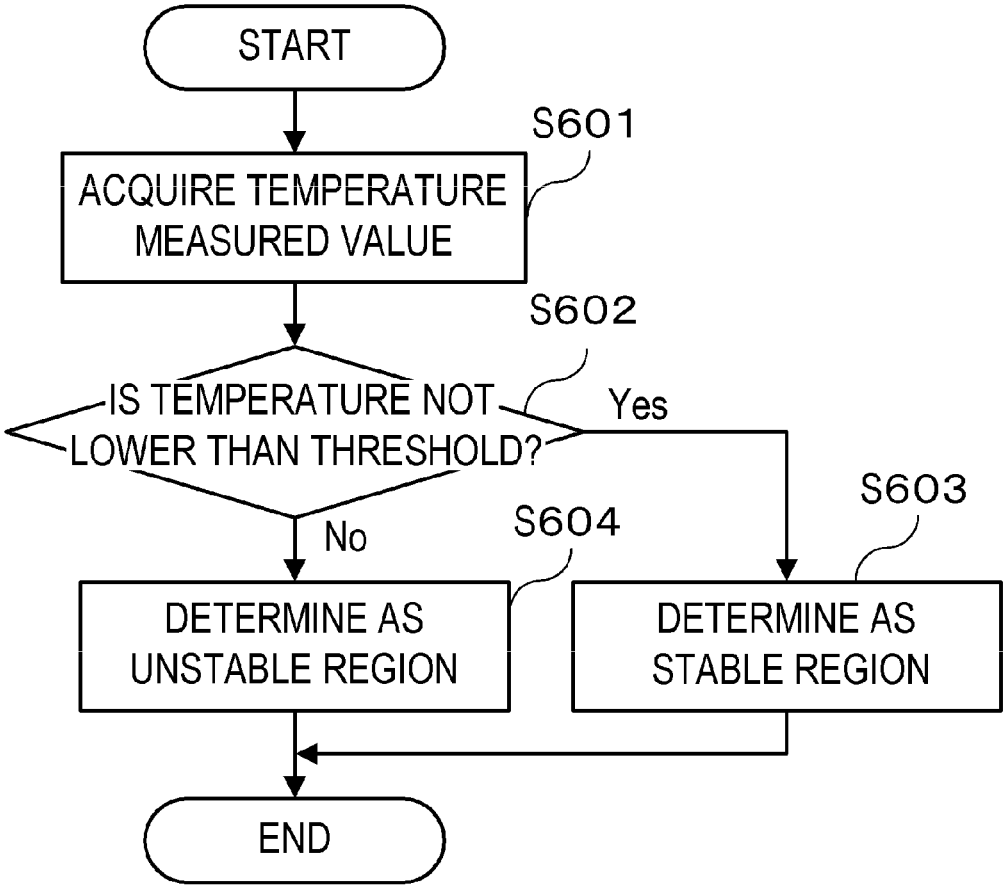
FIG. 6 is a flowchart showing an example of the processing flow of the region identification unit according to Embodiment 2.

An example of the processing flow of the region identification unit 501 is now explained with reference to FIG. 6. Note that, in Embodiment 2, as one example, it is assumed that the region of the screen is divided into 4 lines×6 columns=24 blocks (blocks 1 to 24 of FIG. 8A).

Foremost, the region identification unit 501 sequentially acquires the current temperature measured value of the respective blocks (total of 24 blocks) from the sensor value acquisition unit 203 (S601).

Subsequently, the region identification unit 501 determines, for each block, whether the temperature of that block (temperature represented by the temperature measured value acquired in S601) is a predetermined threshold or higher (S602).

The region identification unit 501 determines that a block in which the temperature is a predetermined threshold or higher is a stable region (S603), and determines that a block in which the temperature is less than a predetermined threshold is an unstable region (S604). The predetermined threshold is, for example, a temperature when the tilting of the temporal change of temperature of an LED becomes smaller than a predetermined value when the backlight (LED) is driven at a predetermined current value (minimum value of temperature that can be deemed saturated).

Figure 7:
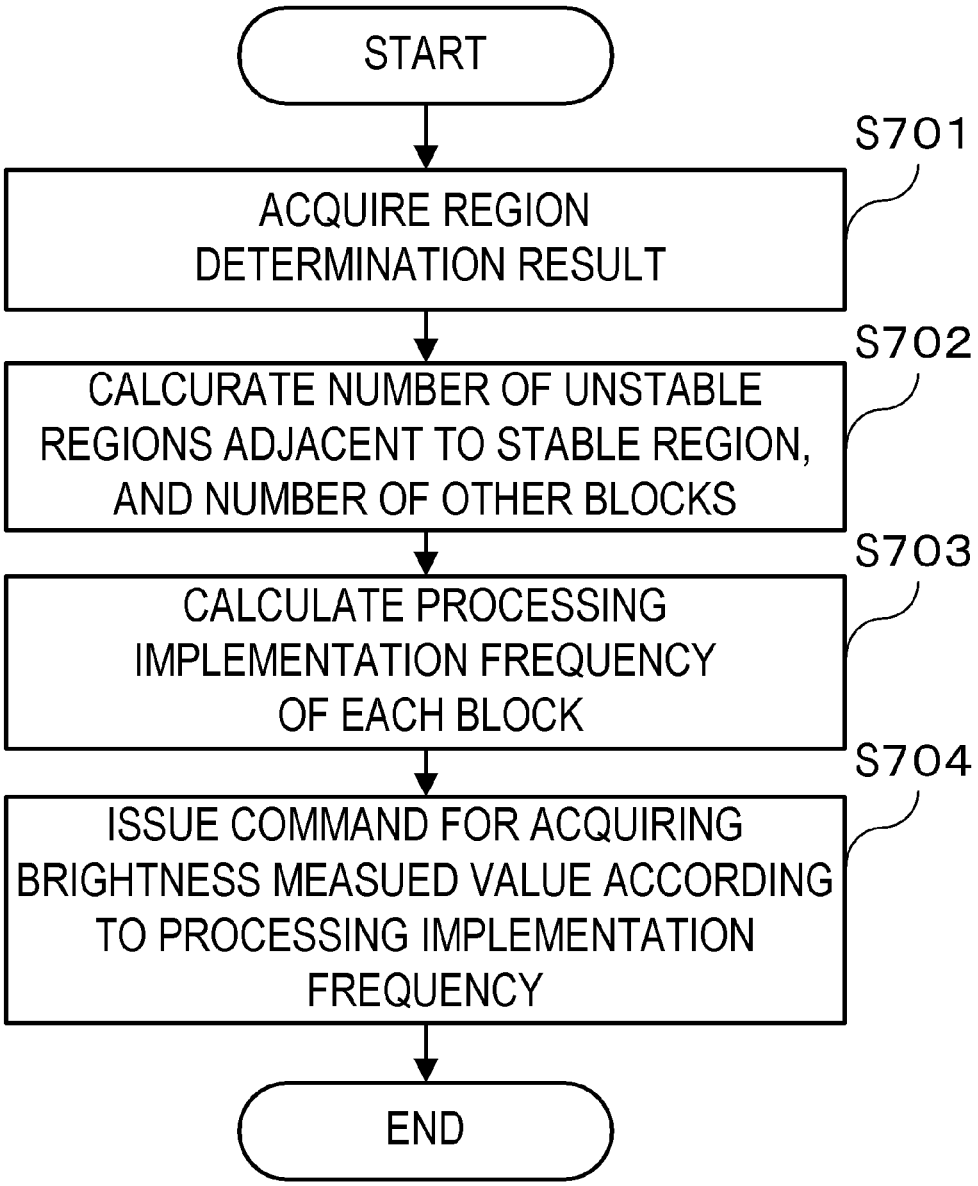
FIG. 7 is a flowchart showing an example of the processing flow of the implementation frequency determination unit according to Embodiment 2.

An example of the processing flow of the implementation frequency determination unit 502 is now explained with reference to FIG. 7 and FIGS. 8A and 8B.

The implementation frequency determination unit 502 includes a memory capable of storing the values (region determination result and processing implementation frequency for each block) shown in FIG. 8B. In this embodiment, an identifier ID for identifying a block is predetermined for each block, and the region determination result and the processing implementation frequency are recorded by being associated with the identifier ID of the corresponding block.

Foremost, the implementation frequency determination unit 502 acquires the region determination result of the respective blocks from the region identification unit 501, and stores the acquired region determination result in the memory (S701). For example, as the region determination result, as shown in FIG. 8A, information showing that the blocks 5, 6, 11, 12 are an unstable region and the other blocks are a stable region is acquired.

Subsequently, the implementation frequency determination unit 502 calculates the number of unstable regions that are adjacent to a stable region and the number of other blocks from the region determination result acquired in S701 (S702). In the example shown in FIG. 8A, the three blocks of 5, 11, 12 are the unstable regions that are adjacent to a stable region. Thus, in S702, the number of unstable regions that are adjacent to a stable region is calculated as 3 regions, and the number of other blocks is calculated as 21 blocks.

Subsequently, the implementation frequency determination unit 502 calculates the processing implementation frequency of the unstable regions that are adjacent to a stable region, and the processing implementation frequency of the other blocks, and records the calculation result in the memory (S703).

Subsequently, the implementation frequency determination unit 502 issues a command to the sensor value acquisition unit 203 for acquiring the brightness measured value of the respective blocks according to the processing implementation frequency of the respective blocks calculated in S703 (S704).

The processing implementation frequency F1 of that unstable regions that are adjacent to a stable region is calculated, for example, according to Formula 1 below. In Formula 1, Fu is the number of the brightness measured value of one block acquired in a unit time when the processing of acquiring the brightness measured value of the respective blocks once is repeated. For example, Fu is the number of the brightness measured value of one block acquired in a unit time when the brightness measured values of from the block 1 to the block 24 are acquired in that order. C is a predetermined coefficient (frequency coefficient).

$$F1=Fu1\times C \quad \text{(Formula 1)}$$

Figure 8A:
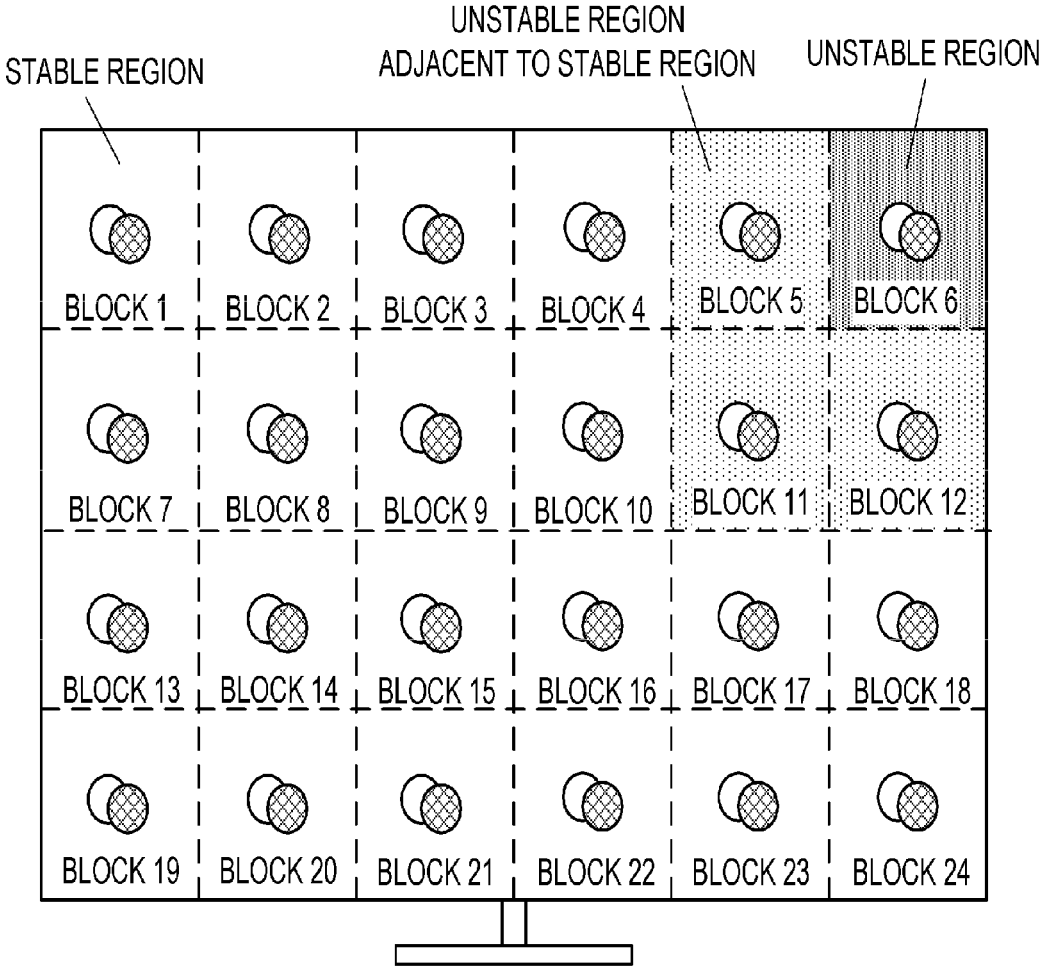

In the example shown in FIG. 8A, when Fu1=2, C=2, as shown in FIG. 8B, the processing implementation frequency F1 of the blocks 5, 11, 12 as the unstable regions that are adjacent to a stable region will be 4.

Moreover, the processing implementation frequency F2 of the blocks other than the unstable regions that are adjacent to a stable region is calculated, for example, according to Formula 2 below. In Formula 2, Fu2 is the total number of the brightness measured values of the respective blocks acquired in a unit time. n1 is the number of unstable regions that are adjacent to a stable region. n2 is the number of blocks other than the unstable regions that are adjacent to a stable region.

$$F2=(Fu2-(F1\times n1))/n2 \quad \text{(Formula 2)}$$

In FIG. 8A, when Fu2=48, since F1=4 (based on Formula 1), n1=3, n2=21, as shown in FIG. 8B, the processing implementation frequency F2 of the blocks other than the unstable regions that are adjacent to a stable region will be 1 (rounded down to nearest decimal).

Note that the method of calculating the processing implementation frequencies F1, F2 is not limited to the foregoing methods. It will suffice so as long as a higher processing implementation frequency is set to the blocks as the unstable regions that are adjacent to a stable region than the other block.

Based on the command issued in S704, the sensor value acquisition unit 203 acquires the brightness measured value of the respective blocks from the plurality of brightness sensors 104 according to the processing implementation frequency of the respective blocks calculated in S703. Moreover, each time a brightness measured value is acquired, the same brightness correction processing as Embodiment 1 is performed.

Figure 9:
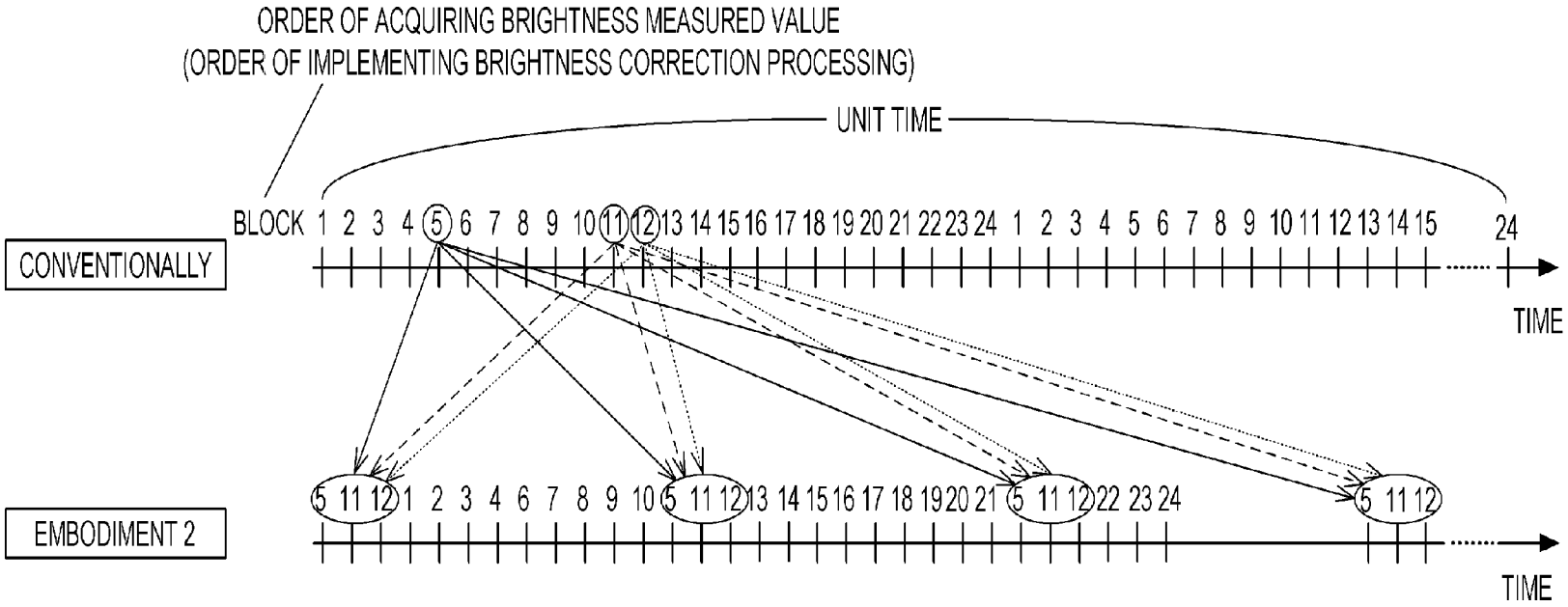
FIG. 9 is a diagram showing an example of the acquisition order of the brightness measured value in a conventional example and in Embodiment 2.
Figure 10A:
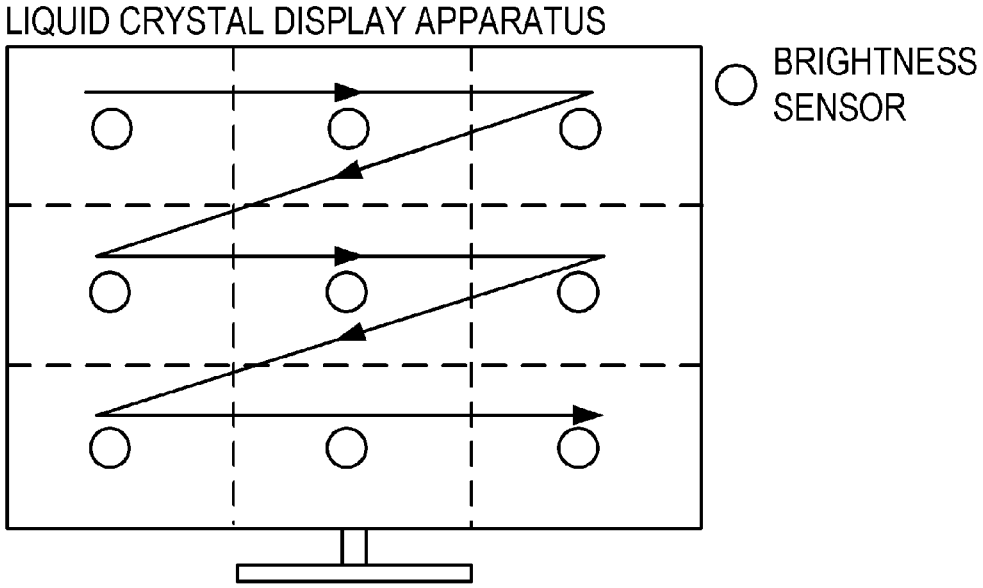
FIGS. 10A to 10C are diagrams showing the state of the conventional brightness correction processing.
Figure 10B:
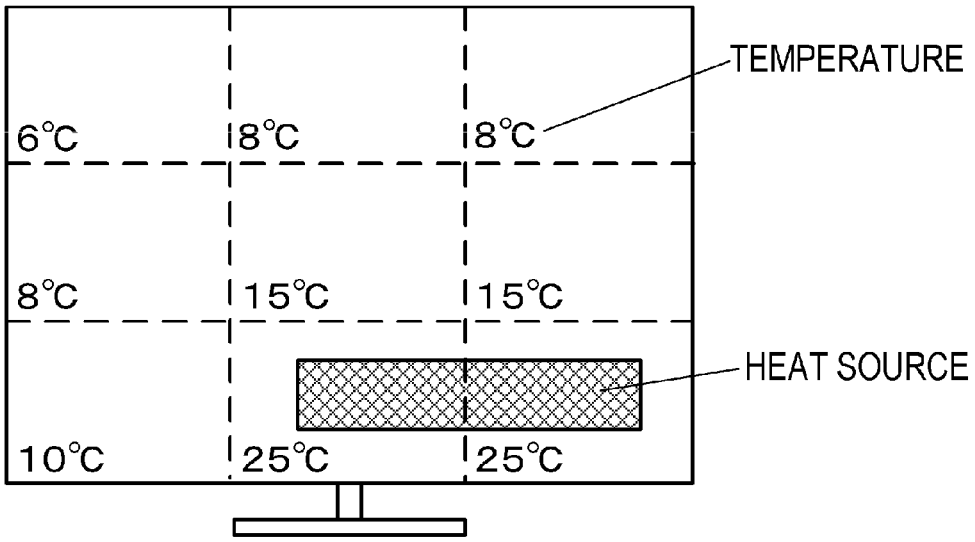
Figure 10C:
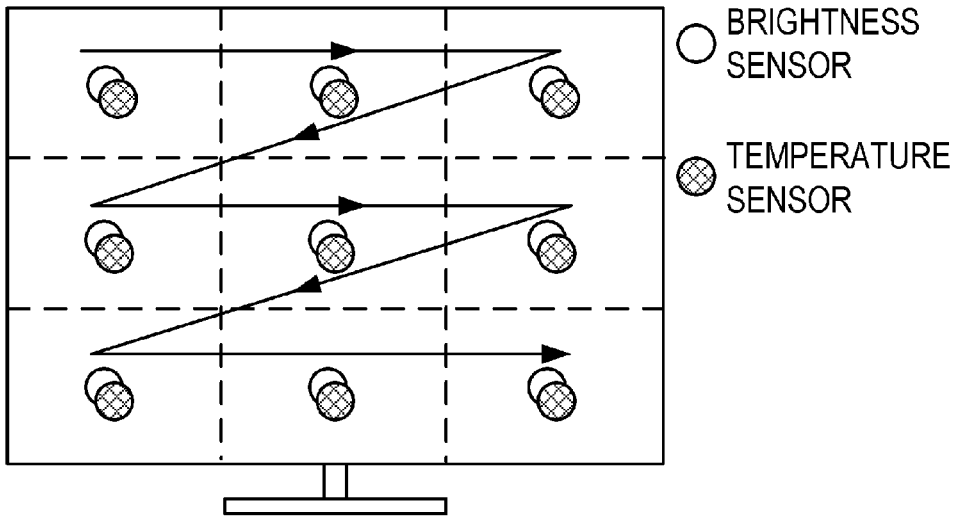

FIG. 9 is a diagram showing an example of the acquisition order of the brightness measured value (implementation order of brightness correction processing) in a conventional method and in Embodiment 2.

Conventionally, the acquisition of the brightness measured value of the respective blocks was performed in a predetermined order. Specifically, as shown in FIG. 9, the brightness measured values from the block 1 to the block 24 were acquired in that order. To put it differently, the block of the brightness measured value to be acquired was switched in order from the block 1 to the block 24.

In Embodiment 2, the brightness measured value of the respective blocks is acquired according to the processing implementation frequency of the respective blocks calculated in S703. Accordingly, the brightness measured value of the respective blocks is acquired according to corresponding processing implementation frequency counts in unit time. Specifically, since the processing implementation frequency of the blocks 5, 11, 12 is 4 (FIG. 8B), the brightness measured value of the blocks 5, 11, 12 is acquired 4 times in a unit time. In the example shown in FIG. 9, after initially acquiring the brightness measured value of the blocks 5, 11, 12 (specified block group), the brightness measured value of the specified block group is acquired 3 times in a unit time so that the interval of acquiring the brightness measured value of the specified block group becomes fixed. Moreover, the brightness measured value of the other blocks is acquired once in a unit time. In the example shown in FIG. 9, during a plurality of periods from acquiring the brightness measured value of the specified block group to subsequently acquiring the brightness measured value of the specified block group, the brightness measured value of the plurality of blocks other than specified block group is acquired by switching the order from the block 1 to the block 24.

As described above, according to this embodiment, regarding the blocks as the unstable regions that are adjacent to a stable region, in a frequency that is higher than the other blocks, the processing of acquiring the measured value of the brightness sensor and controlling the emission brightness of the backlight based on the measured value of the brightness sensor is performed. Consequently, it is possible to cause the emission brightness of the backlight to achieve the target value more accurately in comparison to conventional methods.

Note that, in this embodiment, while the timing of acquiring the temperature measured value, which is to be used in correcting the brightness measured value, from the temperature sensor has not been specified, such a temperature measured value may be acquired at the timing that the brightness measured value is acquired from the brightness sensor. The temperature measured value that was acquired for determining the processing implementation frequency may also be used for correcting the brightness measured value.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-007062, filed on Jan. 17, 2012, and Japanese Patent Application No. 2012-275407, filed on Dec. 18, 2012, which are hereby incorporated by reference herein in their entirety.

What is claimed is:

1. A display apparatus including a light emitting apparatus having a plurality of light sources in which emission of light can be controlled independently, the display apparatus comprising:

a brightness sensor that measures an emission brightness of the light emitting apparatus corresponding to each of blocks constituting a region of an image based on an input image data;

a temperature sensor that measures a temperature of the light emitting apparatus corresponding to each of the blocks; and a control unit that controls, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control unit includes:

an acquisition unit that acquires the measured value of the temperature sensor for each of the blocks; and an emission brightness control unit that performs processing of acquiring the measured value of the brightness sensor and controlling the emission brightness of the light emitting apparatus based on the measured value of the brightness sensor, in order from a block with a greatest difference between a temperature represented by the measured value acquired by the acquisition unit and a temperature represented by the measured value acquired in the past by the acquisition unit.

2. The display apparatus according to claim 1, wherein, when there are a plurality of blocks in which the difference is mutually equal, the emission brightness control unit preferentially controls the emission brightness of the light emitting apparatus corresponding to a block, among the plurality of blocks, which is a lower side adjacent block indicating a higher temperature.

3. The display apparatus according to claim 1, wherein, when there are a plurality of blocks in which the difference is mutually equal, the emission brightness control unit preferentially controls the emission brightness of the light emitting apparatus corresponding to a block, among the plurality of blocks, which is a lower side adjacent block indicating a higher temperature and which has a greater difference in temperature from the lower side adjacent block.

4. A display apparatus including a light emitting apparatus having a plurality of light sources in which emission of light can be controlled independently, the display apparatus comprising:

a brightness sensor that measures an emission brightness of the light emitting apparatus corresponding to each of blocks constituting a region of an image based on an input image data;

a temperature sensor that measures a temperature of the light emitting apparatus corresponding to each of the blocks; and a control unit that controls, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control unit includes:

an acquisition unit that acquires the measured value of the temperature sensor for each of the blocks;

a determination unit that determines, for each block, whether that block is a first region which is a region in which the temperature represented by the measured value acquired by the acquisition unit is not less than a predetermined threshold, or a second region in which the temperature represented by the measured value acquired by the acquisition unit is less than a predetermined threshold; and an emission brightness control unit that performs regarding a block which is the second region adjacent to the first region, at a frequency higher than that for other blocks, processing of acquiring the measured value of the brightness sensor and controlling the emission brightness of the light emitting apparatus based on the measured value of the brightness sensor.

5. A control method for a display apparatus including a light emitting apparatus having a plurality of light sources in which emission of light can be controlled independently, a brightness sensor that measures an emission brightness of the light emitting apparatus corresponding to each of blocks constituting a region of an image based on an input image data, and a temperature sensor that measures a temperature of the light emitting apparatus corresponding to each of the blocks, the control method comprising:

a control step of controlling, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control step includes:

an acquisition step of acquiring the measured value of the temperature sensor for each of the blocks; and an emission brightness control step of performing processing of acquiring the measured value of the brightness sensor and controlling the emission brightness of the light emitting apparatus based on the measured value of the brightness sensor, in order from a block with a greatest difference between a temperature represented by the measured value acquired in the acquisition step and a temperature represented by the measured value acquired in the past in the acquisition step.

6. The control method for a display apparatus according to claim 5, wherein, in the emission brightness control step, when there are a plurality of blocks in which the difference is mutually equal, the emission brightness of the light emitting apparatus corresponding to a block, among the plurality of blocks, which is a lower side adjacent block indicating a higher temperature is preferentially controlled.

7. The control method for a display apparatus according to claim 5, wherein, in the emission brightness control step, when there are a plurality of blocks in which the difference is mutually equal, the emission brightness of the light emitting apparatus corresponding to a block, among the plurality of blocks, which is a lower side adjacent block indicating a higher temperature and which has a greater difference in temperature from the lower side adjacent block.

8. A control method for a display apparatus including a light emitting apparatus having a plurality of light sources in which emission of light can be controlled independently, a brightness sensor that measures an emission brightness of the light emitting apparatus corresponding to each of blocks constituting a region of an image based on an input image data, and a temperature sensor that measures a temperature of the light emitting apparatus corresponding to each of the blocks, the control method comprising:

a control step of controlling, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control step includes:

an acquisition step of acquiring the measured value of the temperature sensor for each of the blocks;

a determination step of determining, for each block, whether a block is a first region in which the temperature represented by the measured value acquired in the acquisition step is not less than a predetermined threshold, or a second region in which the temperature represented by the measured value acquired in the acquisition step is less than a predetermined threshold; and an emission brightness control step of performing, regarding a block which is the second region adjacent to the first region, at a frequency higher than that for other blocks, processing of acquiring the measured value of the brightness sensor and controlling the emission brightness of the light emitting apparatus based on the measured value of the brightness sensor.

9. A display apparatus including a light emitting apparatus having a plurality of light sources in which emission of light can be controlled independently, the display apparatus comprising:

a brightness sensor that measures an emission brightness of the light emitting apparatus corresponding to each of blocks constituting a region of an image based on an input image data;

a temperature sensor that measures a temperature of the light emitting apparatus corresponding to each of the blocks; and a control unit that controls, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control unit includes:

a determination unit that determines, on the basis of change of the temperature measured by the temperature sensor, the order of controlling the emission brightness.

10. The display apparatus according to claim 9, wherein the determination unit determines, as the order of controlling the emission brightness, order from a block with a greatest change of the temperature measured by the temperature sensor.

11. The display apparatus according to claim 9, wherein, when there are a plurality of blocks in which magnitude of the change is mutually equal, the determination unit determines the order so that the emission brightness of the light emitting apparatus corresponding to a block, among the plurality of blocks, which is a lower side adjacent block indicating a higher temperature, is preferentially controlled.

12. The display apparatus according to claim 9, wherein, when there are a plurality of blocks in which magnitude of the change is mutually equal, the determination unit determines the order so that the emission brightness of the light emitting apparatus corresponding to a block, among the plurality of blocks, which is a lower side adjacent block indicating a higher temperature and which has a greater difference in temperature from the lower side adjacent block, is preferentially controlled.

13. The display apparatus according to claim 9, wherein the display apparatus is a liquid crystal display apparatus, and the light emitting apparatus is a backlight.

14. A control method for a display apparatus including a light emitting apparatus having a plurality of light sources in which emission of light can be controlled independently, a brightness sensor that measures an emission brightness of the light emitting apparatus corresponding to each of blocks constituting a region of an image based on an input image data, and a temperature sensor that measures a temperature of the light emitting apparatus corresponding to each of the blocks, the control method comprising:

a control step of controlling, in order, the emission brightness of the light emitting apparatus corresponding to the respective blocks so that the emission brightness approaches a target value by using a measured value of the brightness sensor for each of the blocks and a measured value of the temperature sensor for each of the blocks, wherein the control step includes:

a determination step of determining, on the basis of change of the temperature measured by the temperature sensor, the order of controlling the emission brightness.

15. The control method for a display apparatus according to claim 14, wherein in the determination step, order from a block with a greatest change of the temperature measured by the temperature sensor is determined as the order of controlling the emission brightness.

16. The control method for a display apparatus according to claim 14, wherein, when there are a plurality of blocks in which magnitude of the change is mutually equal, in the determination step, the order is determined so that the emission brightness of the light emitting apparatus corresponding to a block, among the plurality of blocks, which is a lower side adjacent block indicating a higher temperature, is preferentially controlled.

17. The control method for a display apparatus according to claim 14, wherein, when there are a plurality of blocks in which magnitude of the change is mutually equal, in the determination step, the order is determined so that the emission brightness of the light emitting apparatus corresponding to a block, among the plurality of blocks, which is a lower side adjacent block indicating a higher temperature and which has a greater difference in temperature from the lower side adjacent block, is preferentially controlled.

18. The control method for a display apparatus according to claim 14, wherein the display apparatus is a liquid crystal display apparatus, and the light emitting apparatus is a backlight.

* * * * *